US008302524B2

(12) United States Patent
Morse et al.

(10) Patent No.: US 8,302,524 B2
(45) Date of Patent: Nov. 6, 2012

(54) AERODYNAMIC ROTATING LAUNCHER

(75) Inventors: Wayne Morse, Highland, MD (US); Paul Vasilescu, Bethesda, MD (US)

(73) Assignee: American Dynamics Flight Systems, Inc., Jessup, MD (US)

( * ) Notice: Subject to any disclaimer, the term of this patent is extended or adjusted under 35 U.S.C. 154(b) by 204 days.

(21) Appl. No.: 12/629,588

(22) Filed: Dec. 2, 2009

(65) Prior Publication Data

US 2011/0259182 A1 Oct. 27, 2011

Related U.S. Application Data

(60) Provisional application No. 61/119,065, filed on Dec. 2, 2008.

(51) Int. Cl.
*F41F 3/00* (2006.01)

(52) U.S. Cl. ..... 89/1.81

(58) Field of Classification Search ..... 89/1.804, 89/1.815, 1.816, 1.81, 1.8, 1.801, 1.802, 89/1.809, 1.819, 1.803; 102/489, 351; 244/136
See application file for complete search history.

(56) References Cited

U.S. PATENT DOCUMENTS

| | | | | | |
|---|---|---|---|---|---|
| 2,878,678 | A | * | 3/1959 | Hurlburt | 74/5.41 |
| 2,900,874 | A | * | 8/1959 | Tjossem | 89/1.815 |
| 2,931,273 | A | * | 4/1960 | Weatherhead, Jr. | 89/1.817 |
| 2,958,260 | A | * | 11/1960 | Anderson | 89/1.806 |
| 3,172,330 | A | | 3/1965 | Lidmalm et al. | |
| 3,342,104 | A | * | 9/1967 | Robert | 89/1.817 |
| 3,412,640 | A | * | 11/1968 | Nash | 89/1.806 |
| 3,456,552 | A | * | 7/1969 | Nash | 89/1.817 |
| 3,461,801 | A | * | 8/1969 | Harris et al. | 102/357 |
| 3,500,717 | A | * | 3/1970 | Sautier | 89/1.817 |
| 3,710,678 | A | * | 1/1973 | Abelin et al. | 89/1.816 |
| 4,040,334 | A | * | 8/1977 | Smethers, Jr. | 89/1.804 |
| 4,208,949 | A | | 6/1980 | Boilsen | |
| 4,333,384 | A | * | 6/1982 | Arnold | 89/1.803 |
| 4,412,475 | A | * | 11/1983 | Hornby | 89/1.816 |
| 4,455,943 | A | * | 6/1984 | Pinson | 102/489 |
| 4,475,436 | A | * | 10/1984 | Campbell | 89/1.804 |
| 4,637,292 | A | * | 1/1987 | Peterson | 89/1.804 |
| 4,660,456 | A | | 4/1987 | Griffin et al. | |
| 4,681,013 | A | * | 7/1987 | Farley et al. | 89/1.815 |

(Continued)

OTHER PUBLICATIONS

International Search Report and Written Opinion from International Application No. PCT/US2009/066414, mailed Jan. 26, 2010.

*Primary Examiner* — Michael Carone
*Assistant Examiner* — Reginald Tillman, Jr.
(74) *Attorney, Agent, or Firm* — Medler Ferro PLLC

(57) ABSTRACT

A rotating launcher system includes a plurality of rocket or missile housing tubes arranged in a circular pattern within a carousel, a set of frames, a cylindrical protective skin, an aerodynamically optimized nose cone with a bore, and an optional door covering the bore, enabling rockets or missiles to exit the launcher. The rotating launcher system may also include an aerodynamically optimized tail cone with a bore, and an optional door covering the bore, enabling exhaust from the rockets or missiles to exit the launcher. The rotating launcher system also includes an integral controller for an indexing motor, and an indexing motor enabling the bores of the nose and tail cones to align with different rockets or missiles in the carousel by either rotating the nose and tail cones, or by rotating the carousel.

16 Claims, 6 Drawing Sheets

U.S. PATENT DOCUMENTS 5,050,477 A 9/1991 Cowdery et al.
5,058,481 A 10/1991 Drummond et al.
5,605,308 A * 2/1997 Quan et al. ..... 244/173.3
5,915,694 A * 6/1999 Brum ..... 273/359
6,012,375 A * 1/2000 Eckstein ..... 89/1.816
6,834,608 B1 * 12/2004 Ansay et al. ..... 114/312

* cited by examiner

AERODYNAMIC ROTATING LAUNCHER

CROSS-REFERENCE TO RELATED APPLICATION

This application claims the benefit of U.S. provisional patent application No. 61/119,065 filed Dec. 2, 2008, which is hereby incorporated by reference in its entirety herein.

BACKGROUND OF THE INVENTION

Field of the Invention

The present invention relates generally to airborne rocket and missile launching systems and, more particularly, to an aerodynamically optimized rotating launcher.

Summary of the Invention

The rotating launcher disclosed is an airborne rocket and missile launching system designed to reduce drag.

In an embodiment, the rotating launcher system includes: a plurality of rocket or missile housing tubes arranged in a circular pattern within a carousel, a set of frames, a cylindrical protective skin, an aerodynamically optimized nose cone with a bore, and an optional door covering the bore, enabling rockets or missiles to exit the launcher. The rotating launcher system may also include an aerodynamically optimized tail cone with a bore, and an optional door covering the bore, enabling exhaust from the rockets or missiles to exit the launcher. The rotating launcher system also includes an integral controller for an indexing motor, and an indexing motor enabling the bores of the nose and tail cones to align with different rockets or missiles in the carousel by either rotating the nose and tail cones, or by rotating the carousel itself.

In the first configuration for the rotating launcher, an arming signal sent to the integral controller causes the doors over the bores of the nose and tail cones to open and create a clear path for the rocket or missile to exit the launcher. A subsequent firing signal causes the rocket or missile to fire and exit the launcher. Upon exit of the rocket or missile, the integral controller sends a signal to the indexing motor causing it to rotate the nose and tail cones by equal amounts either clockwise or counter-clockwise in order to align the bores of the nose and tail cones with another rocket or missile in the carousel. If the controller receives another firing signal it will repeat the launching sequence. If the controller receives a disarming signal, it will send a signal to the door actuators to close the optional doors covering the bores of the nose and tail cones, if applicable. In this configuration, the carousel is rigidly mounted, and the nose and tail cones are directly coupled together and to the indexing motor by coupled shafts and free to rotate about the longitudinal axis of the launcher based on the indexed position of the motor.

In a second configuration of the rotating launcher, the overall arming, firing and disarming sequences are the same as the first configuration, but the circular carousel housing the rockets or missiles is rotated instead of the nose and tail cones. In this configuration, the nose and tail cones are rigidly mounted and the carousel is coupled to the indexing motor and is free to rotate about the launcher's longitudinal axis based on the indexed position of the motor.

BRIEF DESCRIPTION OF THE FIGURES

Embodiments of the present invention will now be described more fully with reference to the accompanying drawings where like reference numbers indicate similar structure.

DETAILED DESCRIPTION OF THE INVENTION

Figure 1:
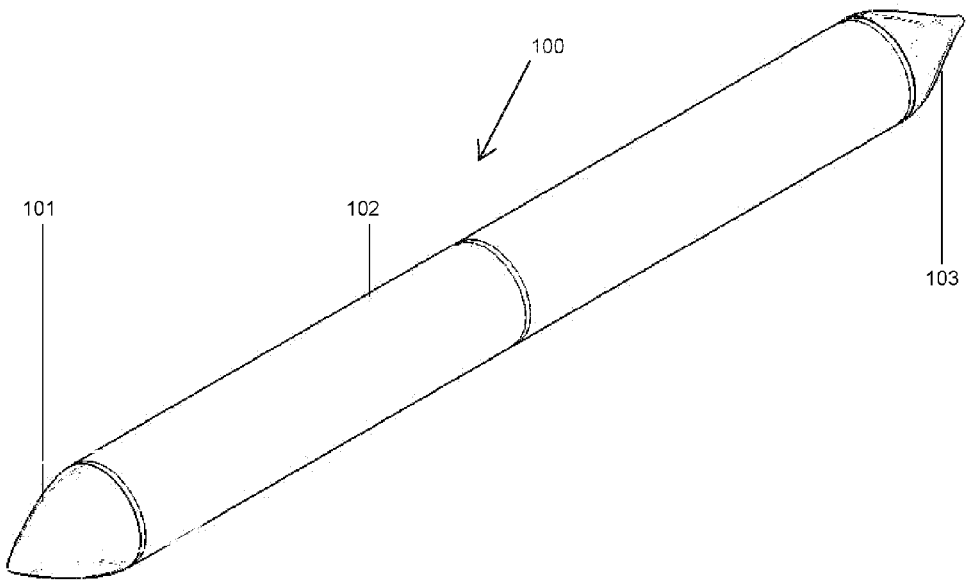
FIG. 1 is a representation of an embodiment of a rotating launcher with the nose and tail cone launch doors closed.
Figure 2:
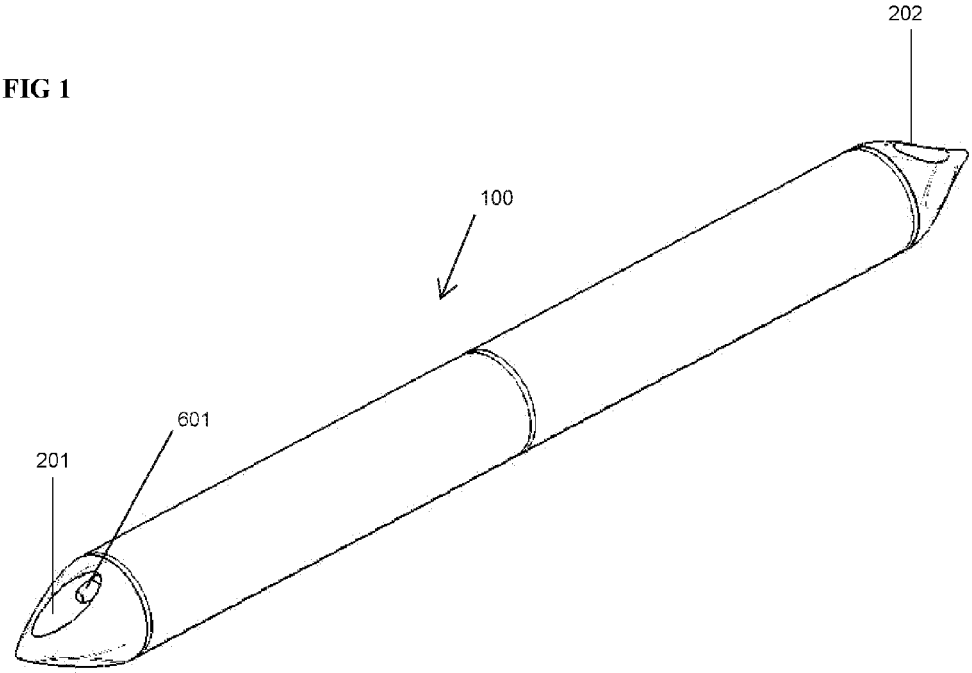
FIG. 2 is a representation of the rotating launcher of FIG. 1 with the nose and tail cone launch doors opened.
Figure 3:
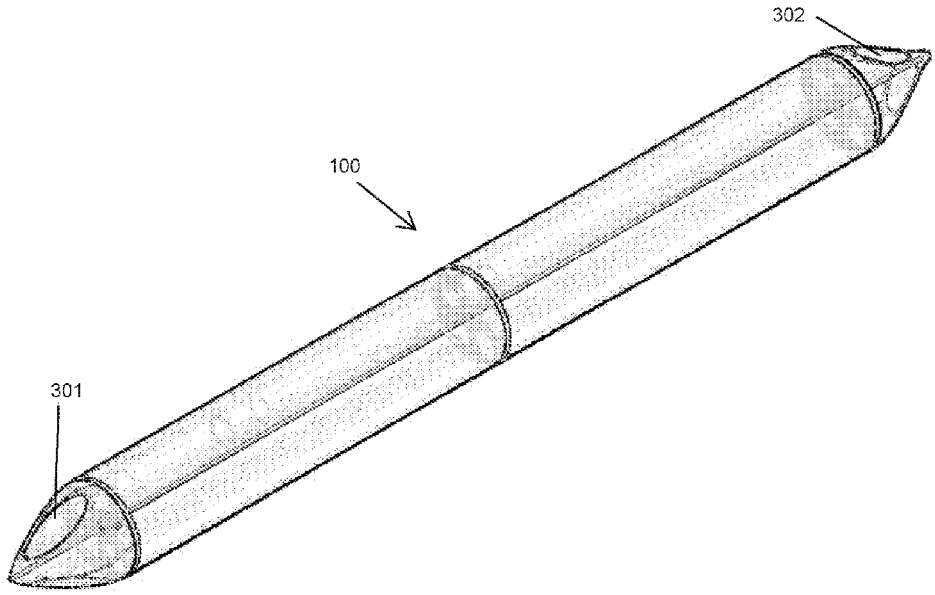
FIG. 3 is a wire frame representation of the rotating launcher of FIG. 1 with internal components visible.

FIG. 1 shows a schematic representation of a rotating launcher 100 in accordance with an embodiment of the present invention. Rotating launcher 100 is an airborne rocket or missile launcher designed to reduce drag. Rotating launcher 100 includes a nose cone 101, skin 102 and a tail cone 103 designed with such a shape as to reduce aerodynamic drag. Nose and tail cones 101/103 have tapered outer surfaces to create the aerodynamic shape. Skin 102 is rigidly mounted to an airframe (not shown). Nose cone 101 and tail cone 103 each have a bore 201, 202, shown in FIG. 2, coaxial to one another, and running parallel to the longitudinal axis 404 of the launcher, in order to enable a rocket or missile to exit launcher 100. Bores 201, 202 may be covered by a nose cone door 301 and a tail cone door 302 to further optimize the rotating launcher. Thus, as shown in FIG. 1, the doors are closed during flight when the rockets or missiles are not needed. The nose cone door 301 and tail cone door 302 have the ability to open mid-flight to expose bores 201, 202, as shown in FIG. 2, in order to create a clear path for the rocket or missile to exit launcher 100. Although the figures show a single bore in each of the nose and tail cones, one skilled in the art would recognize that multiple bores may be utilized. For example, multiple concentric circles of launcher tubes may be utilized and separate bores may be aligned with each of the circles instead of a larger single bore. Further, bores may be provided 180 degrees apart and the nose or tail cone may rotate 180 degrees instead of 360 degrees.

Figure 5:
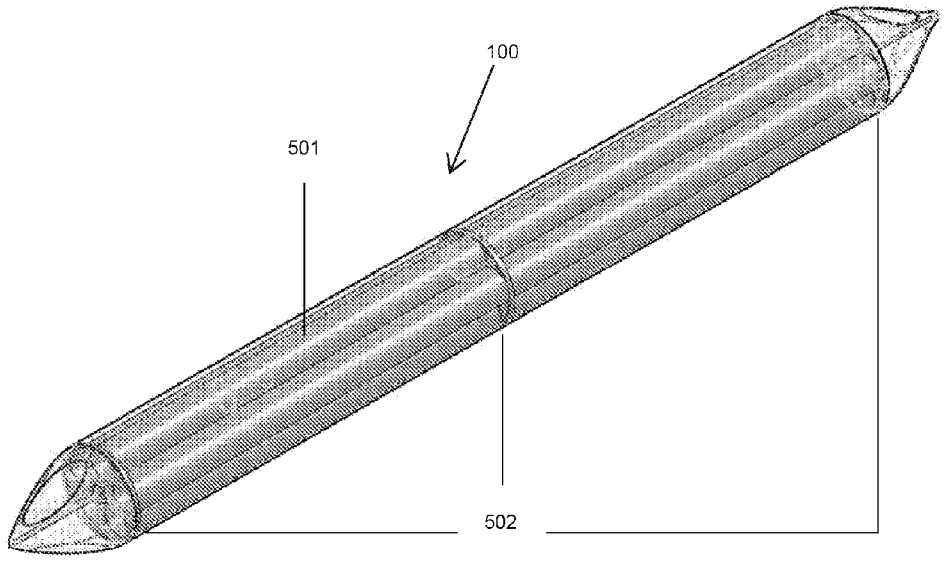
FIG. 5 is a wire frame representation of the rotating launcher of FIG. 1 with a shaded view of the carousel frames and tubes.
Figure 6:
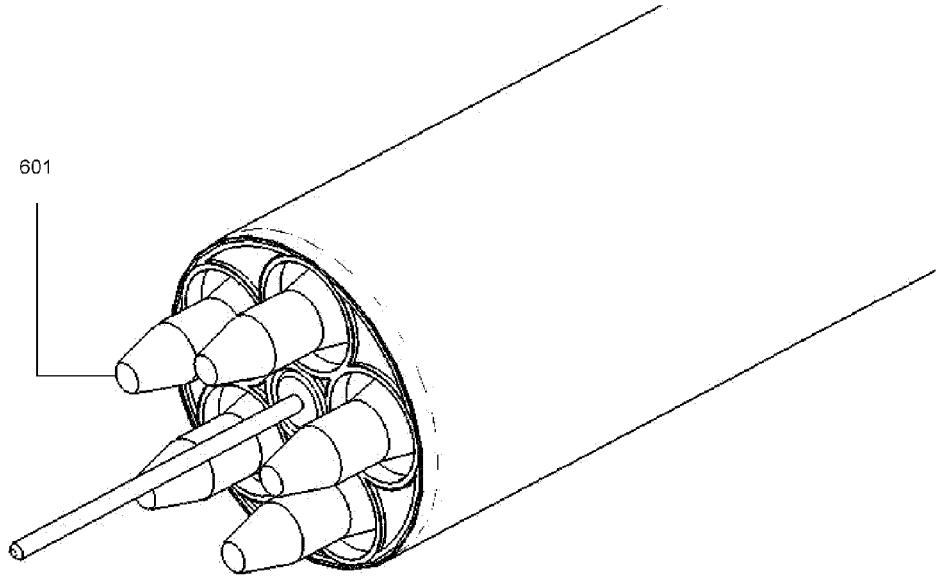
FIG. 6 is a representation of the rotating launcher of FIG. 1 with the nose cone removed and rockets or missiles visible.

The rockets or missiles 601, shown in FIG. 6, are housed inside of tubes 501, shown in FIG. 5, which are preferably arranged in a circular pattern about and the longitudinal axis of the launcher and equidistant from the longitudinal axis of the launcher. Additionally, the bore 201 in nose cone 101, the bore 202 in tail cone 103, and all of the tubes 501 are preferably equidistant from the longitudinal axis of launcher 100.

Figure 4:
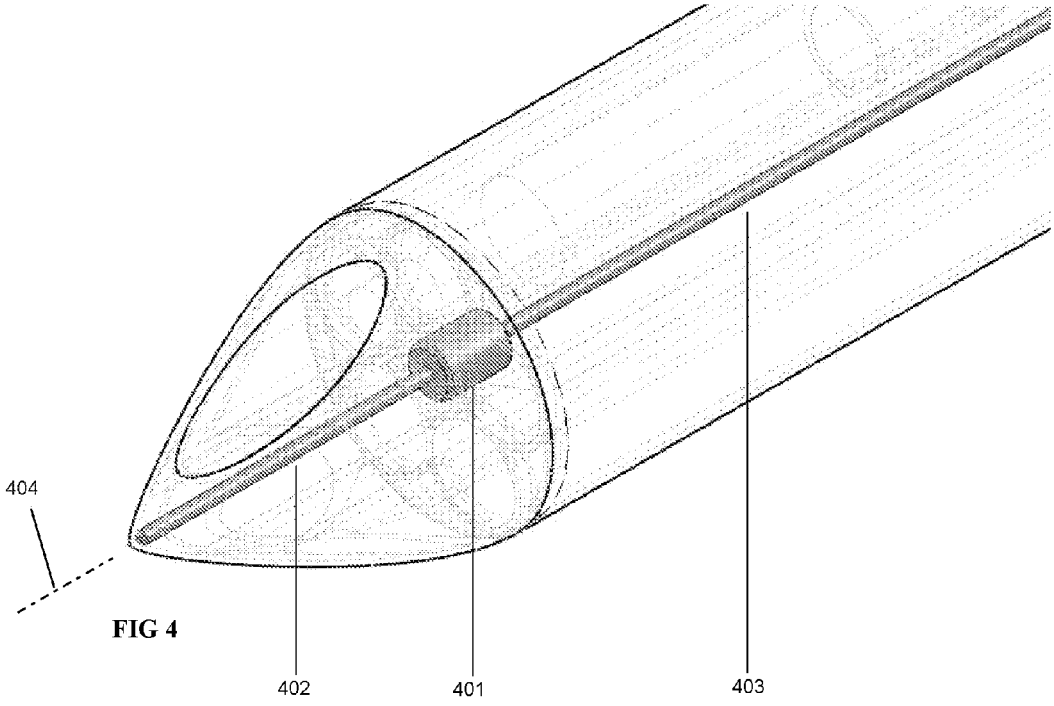
FIG. 4 is a wire frame representation of the rotating launcher of FIG. 1 with a shaded view of the indexing motor and shafts.
Figure 10:
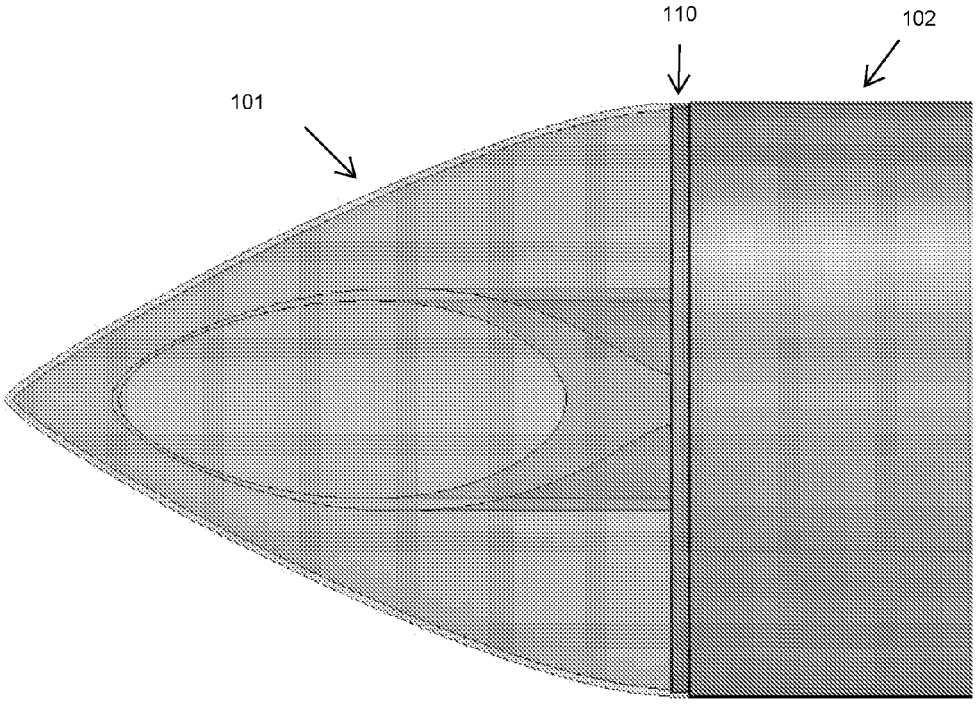
FIG. 10 is a close up view of a portion of the rotating launcher of FIG. 1.

In an embodiment, as illustrated in FIG. 4, an indexing motor 401 is rigidly mounted to one of frames 502. Nose cone 101 and tail cone 103 are free to rotate about the launcher's longitudinal axis 404. Tubes 501 and frames 502 together form the carousel housing the rockets or missiles, and are rigidly mounted to skin 102. Nose cone 101 is coupled to the rotating shaft of indexing motor 401 through shaft 402 and tail cone 103 is coupled to the rotating shaft of indexing motor 401 through shaft 403 such that any rotation of indexing motor 401 to any position causes nose cone 101 and tail cone 103 to rotate by equal amounts. Nose cone 101 and tail cone 103 may be coupled to shafts 402/403 using fasteners such as bolts, welding, or any other coupling known to those skilled in the art. Nose and tail cones 101/103 may be removably coupled to shafts 403/403. Nose and tail cones 101/103 are rotatable relative to the carousel. In one embodiment shown in FIG. 10, a portion of nose cone 101 overlaps skin 102 of the carousel. Skin 102 includes a flange 110 such that there is a smooth transition between nose cone 101 and skin 102, as shown in FIG. 10. Nose cone 101 may also abut skin 102, or other suitable configurations may be used such that nose cone 101 is rotatable relative to skin 102. The configuration shown in FIG. 10 may also be used between skin 102 and tail cone 103. Indexing motor 401 has the ability to rotate nose cone 101 and tail cone 103 through shafts 402 and 403 in such a way as to align bore 201 in nose cone 101 and bore 202 in tail cone 103 with any one of tubes 501. Indexing motor 401 may be a stepper motor, a brushless DC motor with position sensors, or other suitable motors known to those skilled in the art.

Figure 7:
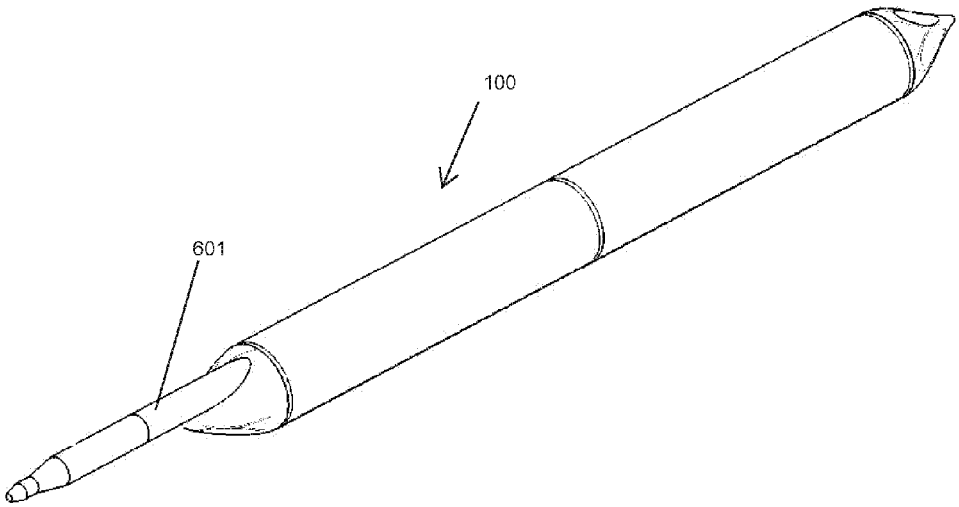
FIG. 7 is a representation of the rotating launcher of FIG. 1 with the nose and tail cones indexed to an initial position, the nose and tail cone doors opened, and a rocket or missile being fired out of the launcher.
Figure 8:
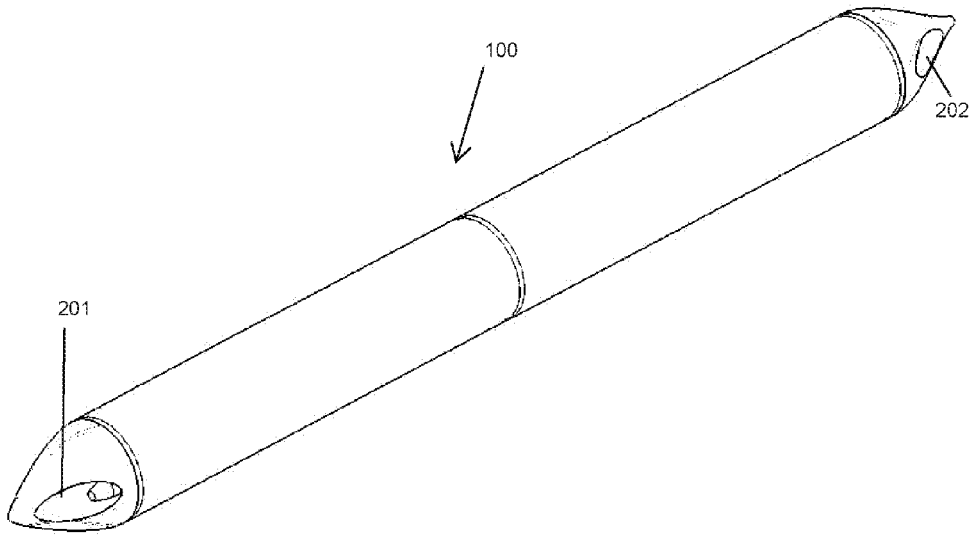
FIG. 8 is a representation of the rotating launcher of FIG. 1 with the nose and tail cones indexed to an alternate position, the nose and tail cone doors opened, and a rocket or missile armed and ready to fire.

Once bores 201, 202 in nose cone 101 and tail cone 103 are aligned with any one of tubes 501, launcher 100 is ready to fire. Once fired, rocket or missile 601, exits the launcher through nose cone 101 as seen in FIG. 7. Once rocket or missile 601 exits the launcher, indexing motor 401 rotates nose cone 101 and tail cone 103 to align bores 201, 202 of nose cone 101 and tail cone 103 with any one of the other tubes 501, as shown in FIG. 8. Once rotation is complete and if the launcher is disarmed, optional nose cone door 301 and optional tail cone door 302 may be closed in order to minimize drag. Alternatively, nose cone door 301 and tail cone door 302 may stay open to enable the next rocket or missile to launch.

In another embodiment, indexing motor 401 is coupled to one of frames 502 such that rotation of indexing motor 401 causes a corresponding rotation of the frame 502. Indexing motor 401 may be coupled to one of frames 502 using fasteners, for example, or by other means known to those skilled in the art. Nose cone 101 and tail cone 103 are rigidly mounted to skin 102 such that nose cone 101 and tail cone 103 do not rotate relative to skin 102. Nose cone 101 and tail cone 103 are also preferably coupled to indexing motor 401 through shafts 402, 403 such that rotation of indexing motor 401 does not rotate nose cone 101 and tail cone 103. Tubes 501 and frames 502 are coupled to each other and are free to rotate as a set (i.e., the carousel) about the launcher's longitudinal axis 404. Due to indexing motor being mounted to one of frames 502, any rotation of indexing motor 401 to any position causes tubes 501 and frames 502 to rotate by equal amounts. Indexing motor 401 has the ability to rotate tubes 501 and frames 502 in such as way as to align the bore 201 in nose cone 101 and the bore 202 in tail cone 103 with any one of the tubes 501. Thus, similar to the embodiment described above, an aircraft (not shown) with launcher 100 attached to it can fly with reduced drag compared to a launcher without nose cone 101 or tail cone 103. The aircraft can fly with the optional doors 301, 302 closed. When a missile or rocket 601 needs to be fired, doors 301, 302 are opened and the missile or rocket 601 is fired, leaving one of the tubes 501 empty. Indexing motor 401 is then rotated, thereby rotating tubes 501 and frames 502 such that one of the tubes 501 with a missile or rocket therein is aligned with bores 201, 202.

Figure 9:
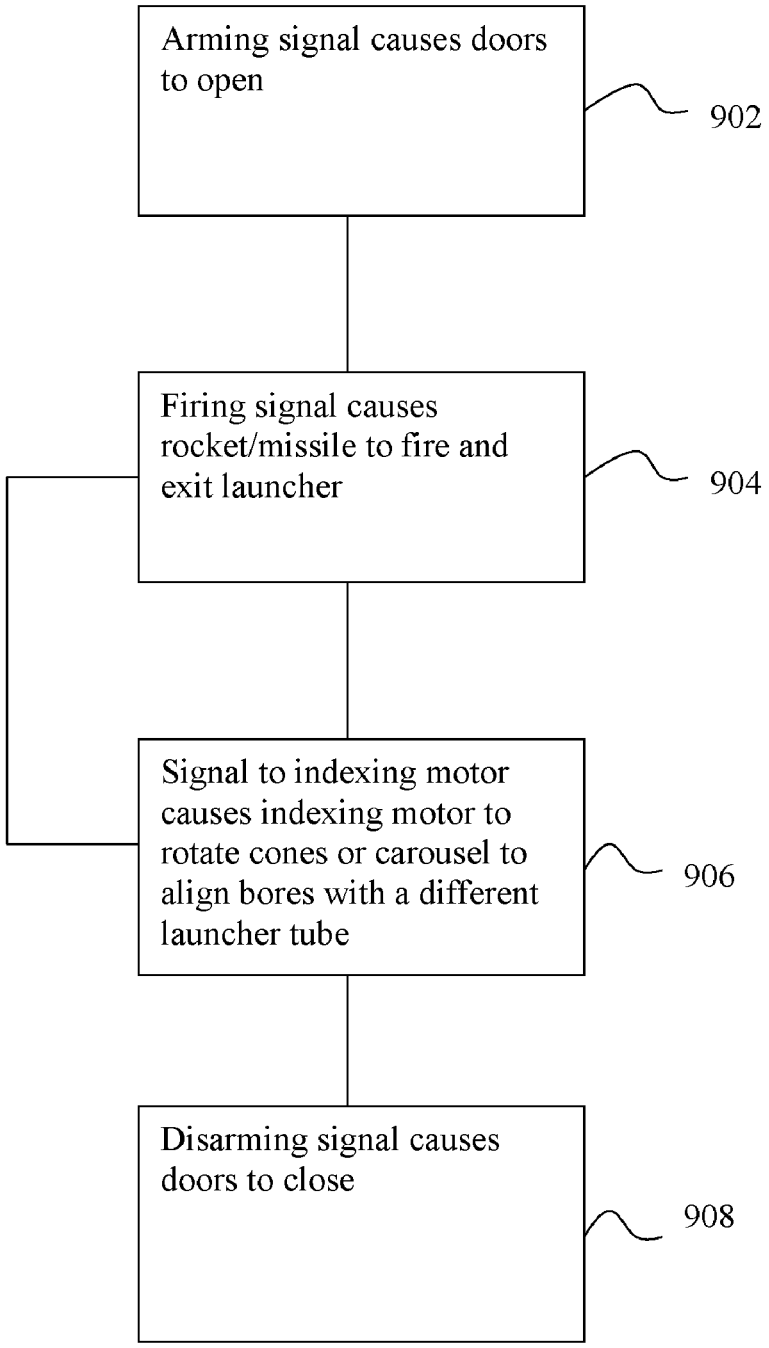
FIG. 9 is a flow chart showing the signaling and control sequence for the rotating launcher.

FIG. 9 illustrates the signaling and control sequence for the rotating launcher. An arming signal 902 is sent to the integral controller to open the optional doors over the bores of the nose and tail cones to create a clear path for the rocket or missile to exit the launcher. A subsequent firing signal 904 causes the rocket or missile to fire and exit the launcher. Upon exit of the rocket or missile, the integral controller sends a signal 906 to the indexing motor causing it to rotate the nose and tail cones by equal amounts either clockwise or counter-clockwise in order to align the bores of the nose and tail cones with another rocket or missile in the carousel. If the controller receives another firing signal it will repeat the launching sequence. If the controller receives a disarming signal 908, it will send a signal to the door actuators to close the optional doors covering the bores of the nose and tail cones, if applicable.

The parts of the launcher system may be made of suitable materials known to those skilled in the art, for example, aluminum, carbon-fiber, and high temperature composite material. As would be understood by those skilled in the art, material selection may be made based on weight, strength, and other relevant characteristics of the material. In a non-limiting example, the skin of the system may be may be made of carbon fiber, the nose and tail cones may be made of carbon fiber and high temperature composite material, the frames may be made of aluminum, the shafts may be made of aluminum or steel, and the launcher tubes may be made of high temperature composite material.

While the particular rotating launcher implementations as herein disclosed and shown through the figures are fully capable of obtaining the objects and providing the advantages a rotating launcher system, they are merely illustrative of the presently preferred embodiments of the invention, and as such, no limitations are intended to the details of construction or design herein shown. Further, while the embodiments have been described with a nose cone and a tail cone, one skilled in the art would recognize that a rotating launcher system with only one of a nose cone or tail cone may be utilized. Similarly, although the particular rotating launcher has been shown with five tubes to hold five missiles, it would be understood that a rotating launcher with more or less tubes and missiles is within the scope of this invention.

What is claimed is:

1. A rocket or missile launching system comprising:

a carousel including a plurality of axially extending launcher tubes arranged in a generally circular pattern about a longitudinal axis of the carousel;

a nose cone coupled to and extending from a first end of the carousel, the nose cone including a tapered outer surface and at least one nose cone bore extending through the nose cone aligned with one of the plurality of launcher tubes; and an indexing motor coupled to the nose cone, wherein the indexing motor is configured to rotate the nose cone relative to the carousel such that the nose cone bore may be aligned with the other of the plurality of launcher tubes.

2. The rocket or missile launching system of claim 1, further comprising a retractable door disposed over the nose cone bore, wherein the door is movable between a closed position closing the bore adjacent the outside surface of the nose cone and an open position wherein the bore extends from the outside surface of the nose cone through an inside surface of the nose cone.

3. The rocket or missile launching system of claim 1, further comprising a tail cone coupled to and extending from a second end of the carousel, the tail cone including a tapered outer surface and at least one tail cone bore extending through the tail cone aligned with the nose cone bore, wherein the indexing motor is coupled to the tail cone such that the indexing motor is configured to rotate the nose cone and the tail cone simultaneously.

4. The rocket or missile launching system of claim 1, further comprising a nose cone retractable door disposed over the nose cone bore, wherein the nose cone retractable door is moveable between a closed position blocking the nose cone bore and an open position allowing access through the nose cone bore.

5. The rocket or missile launching system of claim 4, further comprising a tail cone retractable door disposed over the tail cone bore, wherein the tail cone retractable door is moveable between a closed position blocking the tail cone bore and an open position allowing access through the tail cone bore.

6. The rocket or missile launching system of claim 1, further comprising a controller for controlling the indexing motor.

7. The rocket or missile launching system of claim 1, wherein the carousel further includes skin surrounding the launcher tubes and at least one frame to which the launcher tubes are coupled.

8. The rocket or missile launching system of claim 1, wherein the at least one nose cone bore comprises a single nose cone bore.

9. A rocket or missile launching system comprising:

a carousel configured as an external store to be mounted external to an aircraft's skin, the carousel including a plurality of axially extending launcher tubes arranged in a generally circular pattern about a longitudinal axis of the carousel;

a nose cone coupled to and extending from a first end of the carousel, the nose cone including a tapered outer surface and at least one nose cone bore extending through the nose cone aligned with one of the plurality of launcher tubes; and an indexing motor coupled to the carousel, wherein in the indexing motor is configured to rotate the carousel relative to the nose cone such that the nose cone bore may be aligned with the other of the plurality of launcher tubes.

10. The rocket or missile launching system of claim 9, further comprising a retractable door disposed over the nose cone bore, wherein the door is movable between a closed position closing the bore adjacent the outside surface of the nose cone and an open position wherein the bore extends from the outside surface of the nose cone through an inside surface of the nose cone.

11. A rocket or missile launching system comprising:

a carousel including a plurality of axially extending launcher tubes arranged in a generally circular pattern about a longitudinal axis of the carousel;

a nose cone coupled to and extending from a first end of the carousel, the nose cone including a tapered outer surface and at least one nose cone bore extending through the nose cone aligned with one of the plurality of launcher tubes;

an indexing motor coupled to the carousel, wherein in the indexing motor is configured to rotate the carousel relative to the nose cone such that the nose cone bore may be aligned with the other of the plurality of launcher tubes; and a tail cone coupled to and extending from a second end of the carousel, the tail cone including a tapered outer surface and at least one tail cone bore extending through the tail cone aligned with the nose cone bore, wherein the indexing motor is configured to rotate the carousel relative to the tail cone.

12. The rocket or missile launching system of claim 11, further comprising a nose cone retractable door disposed over the nose cone bore, wherein the nose cone retractable door is moveable between a closed position blocking the nose cone bore and an open position allowing access through the nose cone bore.

13. The rocket or missile launching system of claim 12, further comprising a tail cone retractable door disposed over the tail cone bore, wherein the tail cone retractable door is moveable between a closed position blocking the tail cone bore and an open position allowing access through the tail cone bore.

14. The rocket or missile launching system of claim 9, further comprising a controller for controlling the indexing motor.

15. The rocket or missile launching system of claim 9, wherein the carousel further includes skin surrounding the launcher tubes and at least one frame to which the launcher tubes are coupled.

16. The rocket or missile launching system of claim 9, wherein the at least one nose cone bore comprises a single nose cone bore.

* * * * *